United States Patent [19]

Doutrich et al.

[11] 4,001,464

[45] Jan. 4, 1977

[54] PROCESS FOR FORMING A SOLDER BAND

[75] Inventors: Ray Charles Doutrich, Lebanon; Richard Eugene Fry, York, both of Pa.

[73] Assignee: E. I. Du Pont de Nemours and Company, Wilmington, Del.

[22] Filed: Apr. 29, 1975

[21] Appl. No.: 572,833

[52] U.S. Cl. ..... 427/58; 427/123; 427/356; 427/357; 427/359; 427/360; 427/374 C; 427/376 H; 427/428

[51] Int. Cl.[2] ..... B05D 5/12

[58] Field of Search ..... 427/58, 123, 177, 289, 427/356, 357, 359, 360, 376, 383, 398, 420, 428, 374; 29/630 A, 630 D

[56] References Cited

UNITED STATES PATENTS

| | | | |
|---|---|---|---|
| 3,158,498 | 11/1964 | Carpenter | 427/356 |
| 3,563,781 | 2/1971 | Johnson | 427/428 |
| 3,645,784 | 2/1972 | Helgeland et al. | 427/428 |
| 3,713,876 | 1/1973 | Lavric | 427/123 |
| 3,780,433 | 12/1973 | Lynch | 29/630 D |

*Primary Examiner*—Cameron K. Weiffenbach

[57] ABSTRACT

A process and apparatus for coating a band of a composition about a medial portion of an electrical component lead or terminal, where a continuous ribbon of a coating composition is extruded onto a medial portion of a plurality of spaced discrete leads or terminals extending transversely from a carrier strip. The continuous ribbon of coating composition is festooned between adjacent pins to coat paste on the sides of the leads or terminals. The leads or terminals and festoonery are transported over a surface of a wheel to apply the coating composition to the underside of each lead or terminal. A cut-off blade removes the excess composition from the underside of the terminal pins, as the pins leave the surface of the application wheel.

6 Claims, 8 Drawing Figures

PROCESS FOR FORMING A SOLDER BAND

BACKGROUND OF THE INVENTION

FIELD OF THE INVENTION

The present invention relates to a process and apparatus for coating a band of a coating composition about an element; and particularly relates to a process and apparatus for selectively coating a band of solder paste about an electrical terminal or component lead, flowing the solder paste to provide a layer of molten solder and fusing the layer of solder about the terminal or component.

BACKGROUND OF THE INVENTION

Electrical components having tinned or solder-coated leads are well-known in the art. A tinning apparatus for resistors is described in U.S. Pat. No. 2,935,962. The apparatus of this patent uses endless belts to transport electrical components, and apply a coating of solder to leads of electrical components extending into a solder bath. Circuit board pins having a coating of solder about the periphery, thereof, are described in U.S. Pat. No. 3,331,912. The pins are coated by submersion in a solder bath. Electrical terminal pins having solder coated on a medial mounting portion, thereof, are described in IBM Technical Disclosure Bulletin, Volume 9, No. 4, September, 1966, at page 366.

An apparatus and process for applying a band of solder about a medial portion of an electrical terminal pin is described in U.S. Pat. No. 3,849,870. This patent discloses transporting a plurality of terminal pins through a fixture partially submerged in a wave-soldering apparatus. The fixture has channels with solder-resistant surfaces which form a mask limiting spreading of the solder from the medial portion of the pin.

A process for soldering printed circuit board assemblies with solder paste and infra-red radiation using an elliptical reflector to flow the solder is described in U.S. Pat. No. 3,583,063. Solder paste compositions are described in U.S. Pat. No. 3,684,533.

Generally, the processes and apparatuses of the prior art including dip and wave soldering techniques, wherein an electrical component lead or terminal is dipped into a pot of molten solder or passed over a wave of molten solder, require expensive equipment and fixtures which are not readily adaptable for handling various types of electrical component leads and terminals. Additionally, such techniques require maintaining a molten solder bath. The solder bath can be contaminated so the solder does not provide effective electrical connections when reflowed. The use of paste solder compositions as described in U.S. Pat. Nos. 3,684,533 and 3,583,063 obviates the requirements for maintaining baths of molten solder, but requires the use of screen printing or masking techniques for applying the solder paste to a substrate or circuit board. The screen printing or masking requires separate preparation of a mask or screen for the individual substrate or circuit board to which the solder paste is to be applied.

The present invention invention provides a significant advance in the art in that a band of solder paste is applied to an electrical component lead or terminal and flowed to form a coating or layer and fused about the component lead or terminal. The component lead or terminal having a band or layer of fused solder may then be inserted into a hole in a substrate, or circuit board, and the solder reflowed to effect an electrical connection between the electrical component lead or terminal and a conductive path on the substrate or circuit board.

SUMMARY OF THE INVENTION

According to the present invention, a process is provided for coating a composition about an electrical element comprising transporting a plurality of elements along a feed path with at least one segment of each element extending transversely of the feed path, extruding a continuous ribbon of coating composition onto the segment of each element extending transversely of the feed path, festooning the continuous ribbon of coating composition between adjacent elements to provide a layer of coating composition on the sides of each element, and transporting the elements and festoonery onto a surface of an application wheel to apply coating composition to the underside of each element. Preferably, the process additionally comprises the steps of cutting excess coating composition adhering to the underside of each element as the elements are transported away from the surface of the application wheel, and leveling the coating composition adhering to the application wheel previous to transporting the elements over the application wheel. The process is particularly useful for applying a band of paste solder about a medial portion of an electrical terminal pin. The band of solder paste is flowed by heating and fused by cooling to form a band of solder about a medial portion of the pin.

Additionally, an apparatus is provided for applying a coating composition about an electrical element comprising a feed path for transporting a plurality of elements with at least one segment of each element extending transversely of the feed path, means mounted above the feed path for extruding a continuous ribbon of coating composition onto the segment of the elements extending transversely of the feed path, an application wheel mounted below the feed path a predetermined distance along the feed path from the means for extruding the coating composition to provide festooning of the coating composition between adjacent elements, the wheel having a surface for engaging a segment of the elements transported along the feed path and applying the coating composition to the underside of each element. Preferably, the apparatus additionally comprises means adjacent a surface of the application wheel for cutting excess coating composition adhering to the underside of each element as the elements are transported along the feed path away from the surface of the application wheel. Also, an adjustable leveling or doctor blade is mounted adjacent the surface of the wheel a spaced distance from the surface for controlling the thickness of the coating composition applied to the underside of the elements and for removing any excess coating composition from the surface of the application wheel.

The process and apparatus of the invention provides for economically and efficiently applying a coating composition, e.g. a band of solder paste about a segment of an electrical component lead or an electrical terminal. The invention provides for controlling the thickness of the coating composition and obviates the requirements of the prior art requiring molten solder baths for submersion of the element to be coated using molten solder or the requirement for a printing screen or mask for applying a solder paste to a substrate or a circuit board. The coating process and apparatus of the present invention is particularly useful for applying a solder paste which can be coated onto the elements and then flowed and fused to form a metallic coating on the element. The elements having the fused solder coating thereon can be inserted into holes in a circuit board and the solder can be reflowed to establish electrical and mechanical connections to a conductive path on the substrate or circuit board.

BRIEF DESCRIPTION OF THE DRAWINGS

FIG. 3 is a fragmentary elevation view in section of the apparatus of FIG. 1 taken along line 3—3 of FIG. 1.

DETAILED DESCRIPTION OF THE INVENTION

Figure 1:
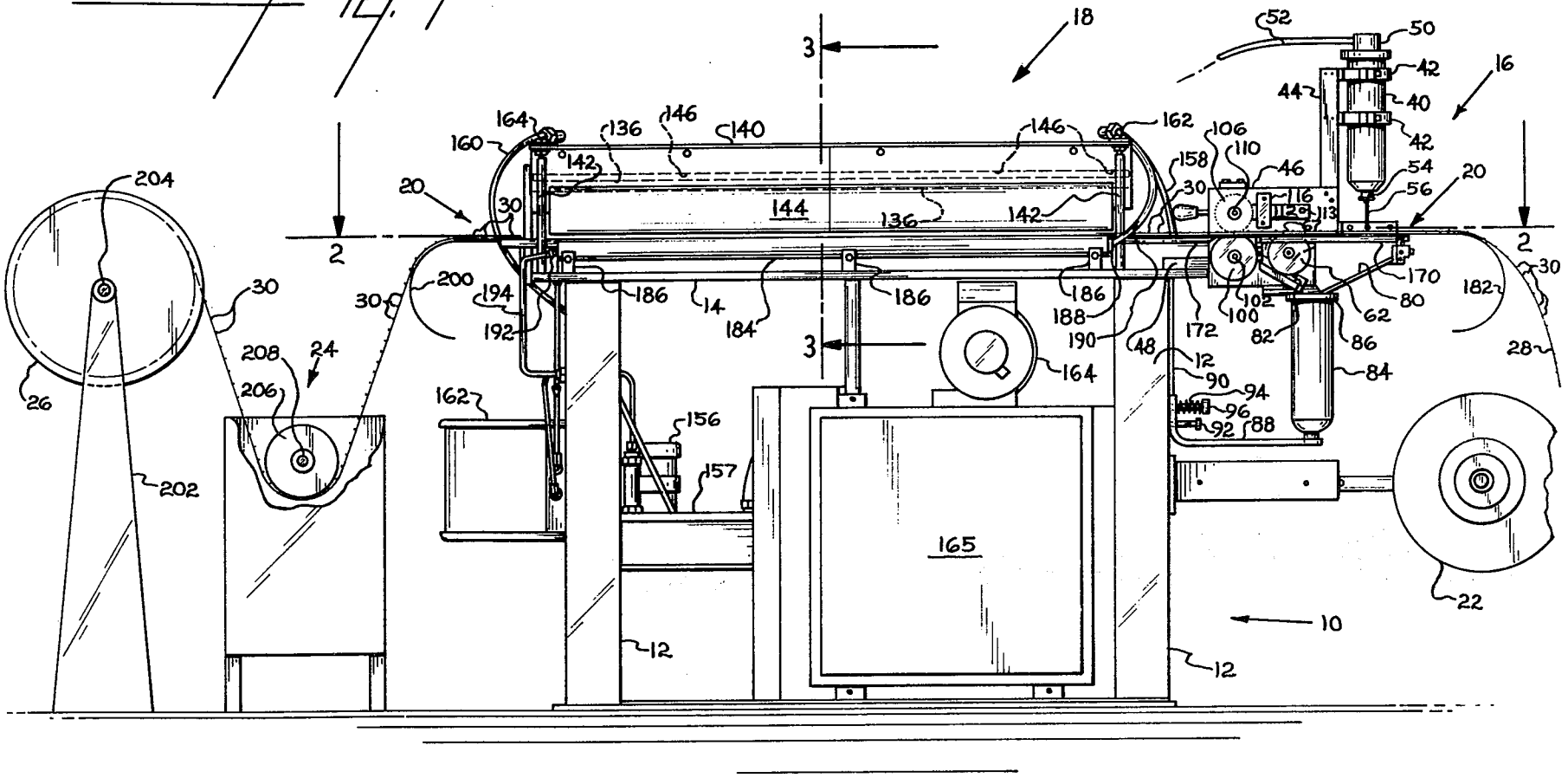
FIG. 1 is a side elevation view of an apparatus according to the invention.

An apparatus and process embodying the invention is described below with reference to the attached drawings wherein the same numerals are used throughout to identify the same elements.

Generally, a preferred embodiment of an apparatus according to the invention comprises a frame 10 having legs 12 and a table 14 mounted on the frame 10. A coating station 16 is mounted at one end of the table 14 and an infra-red heating station 18 is mounted on table 14. A feed path 20 extends through the coating station 16 and heating station 18. A terminal supply reel 22 is provided for supplying terminals to the feed path 20. A flux cleaning bath 24 is provided for cleaning the terminals and a terminal take-up reel 26 is provided for reeling the terminals 30 having a fused solder band 38 about a medial portion 29 of each terminal 30.

Figure 8:
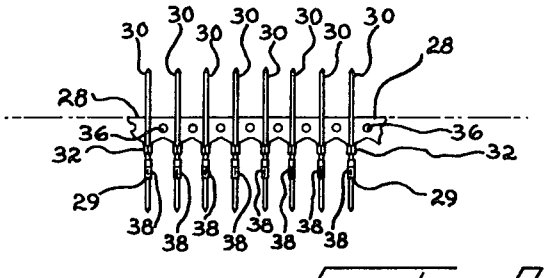
FIG. 8 is a plan view illustrating a plurality of terminals having fused solder bands about a medial portion thereof.

With particular reference to FIGS. 1 and 8, a carrier strip 28 having a plurality of terminal pins 30 attached to and extending transversely of a carrier strip 28 is supplied to the feed path 20 from terminal supply reel 22. The terminal pins 30 are mounted in ferrules 32 connected to the carrier strip 28 by standoff 34. Pilot holes 36 are provided in the carrier strip 28 for advancing the carrier strip and terminals 30 along the feed path 20 through the coating station 16 and the infra-red heating station 18.

Figure 5:
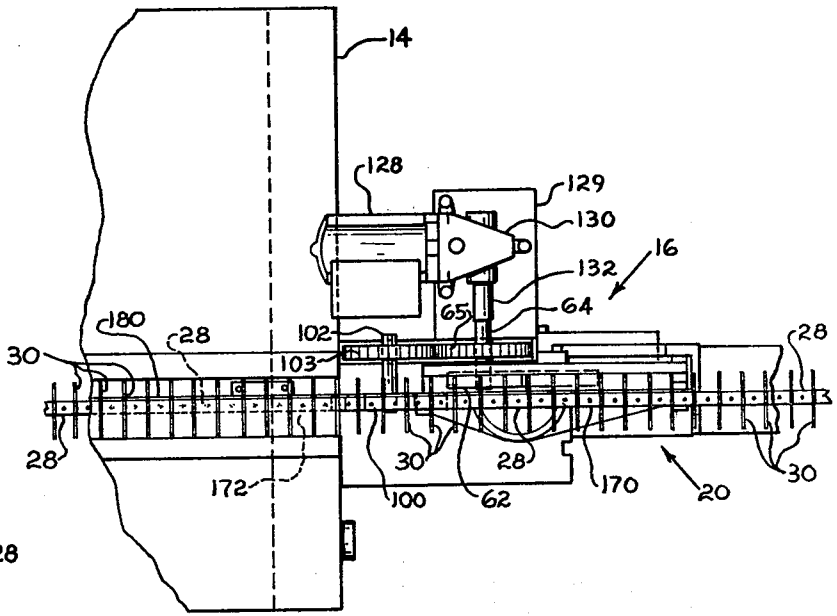
FIG. 5 is a fragmentary detailed plan view in section along line 5—5 of FIG. 4.
Figure 4:
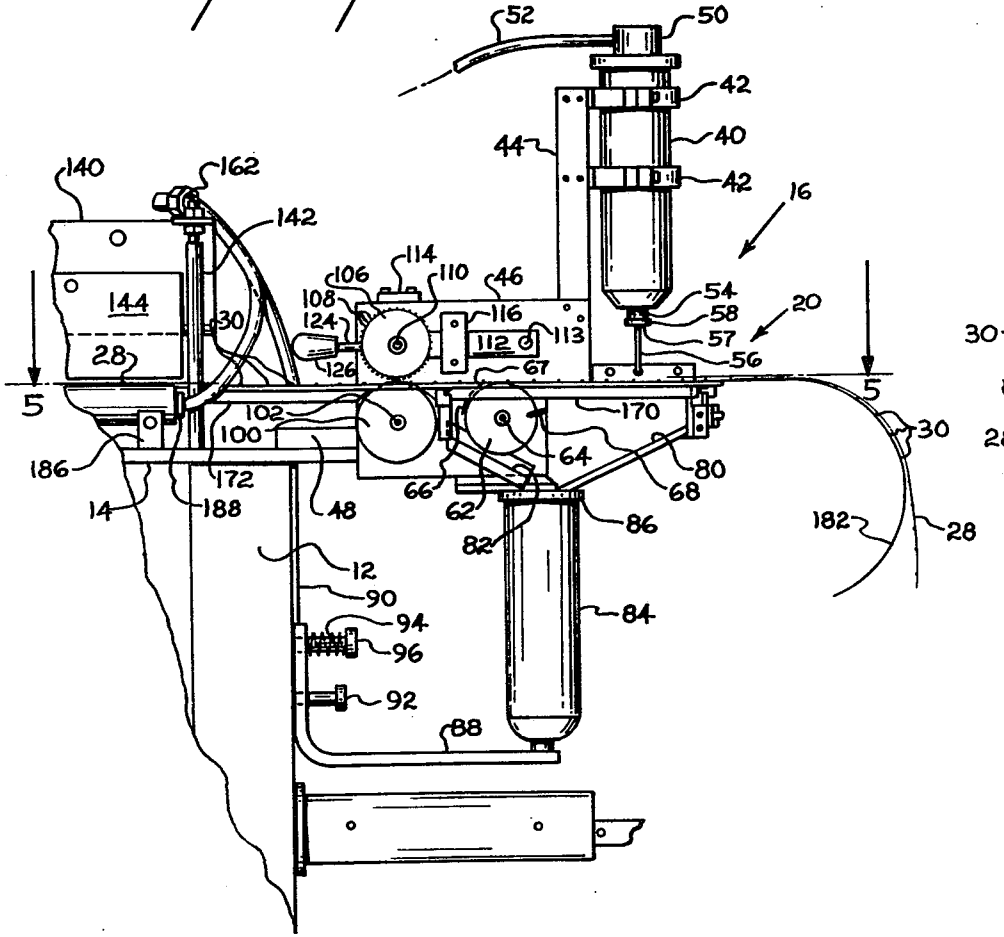
FIG. 4 is a fragmentary detailed elevation view of the apparatus of FIG. 1.

With particular reference to FIGS. 4 and 5, the coating station 16 includes an extrusion hopper 40 mounted by bands 42 on stanchion 44 above the feed path 20. Stanchion 44 is mounted to a plate 46 on a support member 48 extending from table 14. A pressurized cap 50 is provided for hopper 40. The hopper 40 is connected to a regulated air source (not illustrated) through air line 52. An internally-threaded outlet flange 54 is provided at the bottom of the extrusion hopper. An extrusion needle 56 having an expanded mounting section 57 including nut 58 is thread mounted in flange 54.

Figure 6:
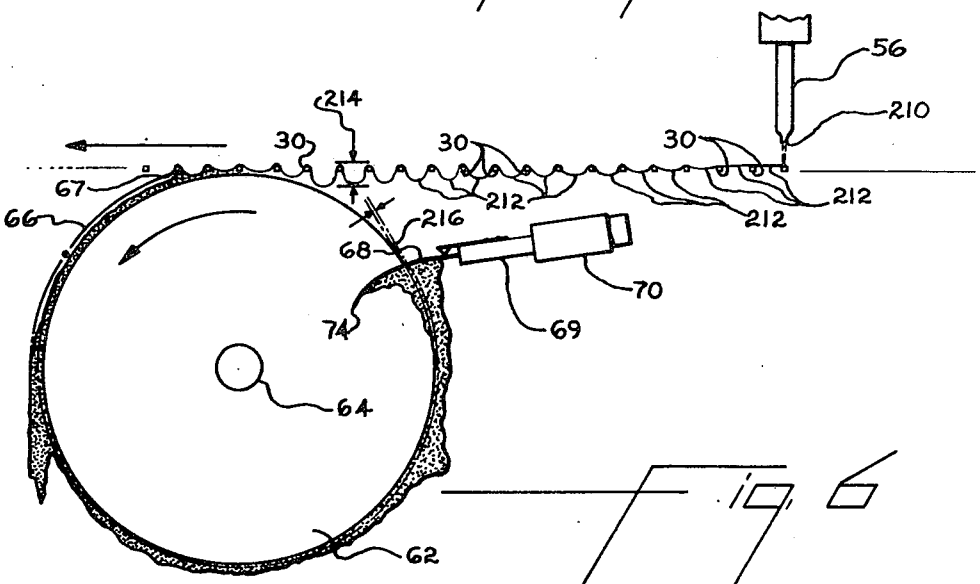
FIG. 6 is a detailed elevation view broken-away to illustrate the process of the invention.
Figure 7:
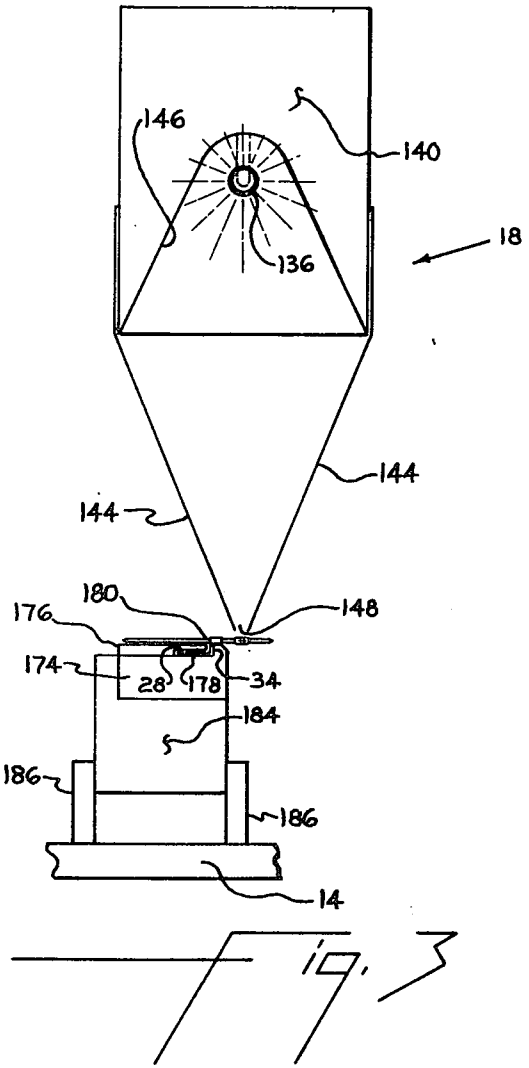

With additional reference to FIG. 6, a solder application wheel 62 is mounted on shaft 64 which is rotatably journaled in mounting plate 46. A drive gear 65 is mounted on shaft 64 on the other side of plate 46. An arcuate cut-off blade 66 is mounted on plate 46 having edge 67 mounted a spaced distance from the wheel 62. A leveling blade 68 is mounted on shaft 69 of micrometer 70. Micrometer 70 is mounted in a mounting block (not illustrated) on plate 46. An edge 72 of the leveling blade 68 is adjustably spaced from the surface of application wheel 62. A pair of legs 74 at each end of the leveling edge extend over each side of the wheel 62.

A first inclined drip slide 80 is mounted below needle 56 on plate 46 and a second inclined drip slide 82 is mounted below the solder application wheel 62 on plate 46. A drip tank 84 is spring mounted against a collar 86 mounted on plate 46 for receiving excess coating compositions from the drip slides 80 or 82. A support arm 88 pivotally mounted on a cross member 90 between legs 12 of frame 10 supports the drip tank 84. Support arm 88 is pivotable about mounting bolt 92 on cross-member 90. A spring 94 on shoulder bolt 96 thread mounted in cross member 90 provides spring loaded support for drip tank 84. A feed wheel 100 is mounted on shaft 102 which is rotatably journaled in plate 46. A drive gear 103 is mounted on shaft 102 on the other side of plate 46. A drive sprocket 106 having cogs 108 is mounted on shaft 110 which is rotatably journaled in arm 112. Arm 112 is pivotally mounted on pin 113 mounted in plate 46. An arm support member 116 is mounted on plate 46 over arm 112. A mounting block 114 on plate 46 holds a spring (not illustrated) mounted therein. The spring loaded arm 112 engages drive sprocket 106 against the carrier strip 28 on feed wheel 100. A drive gear (not illustrated) is mounted on shaft 110 on the other side of plate 46. A lever 124 with hand grip 126 for disengaging sprocket 106 extends from the free end of arm 112.

A drive motor 128 is mounted on a plate 129 mounted to plate 46 on support member 48. A right angle gear reducer drive 130 is mounted on motor 128. An output shaft 132 of gear reducer 130 is directly coupled to shaft 64. Gear 103 on shaft 102 is engaged with and driven directly at a one-to-one ratio with gear 65 on shaft 64. A gear (not illustrated) on shaft 110 mounted in arm 112 is in engagement with gear 103 on shaft 102 and also driven directly at a one-to-one ratio. A gear box (not illustrated) encloses the gear train.

With particular reference to FIGS. 1 and 3, the heating station 18 comprises an infra-red lamp 136 mounted longitudinally in the heating station. A parabolic reflector 146 is mounted in communication with lamp cooling unit 140. The lamp cooling unit 140 is mounted on support members mounted on table 14. A pair of focusing shields 144 are mounted on lamp cooling unit 140. The focusing shields 144 form a longitudinal slot 148 above the feed path 20. Reflector 146 focuses the radiation from lamp 136 through slot 148.

The lamp cooling unit 140 has an input port 162 and an output port 164. A pump 156 supplies cooling liquid, e.g. water, to input port 162 through cooling line 158. Pump 156 is mounted on a supply tank 157. A cooling line 160 from output port 164 returns the cooling liquid to an evaporative cooler 162 mounted on frame 10. A rheostat 164 mounted on a control box 165 is provided for controlling the voltage to lamp 136.

Figure 2:
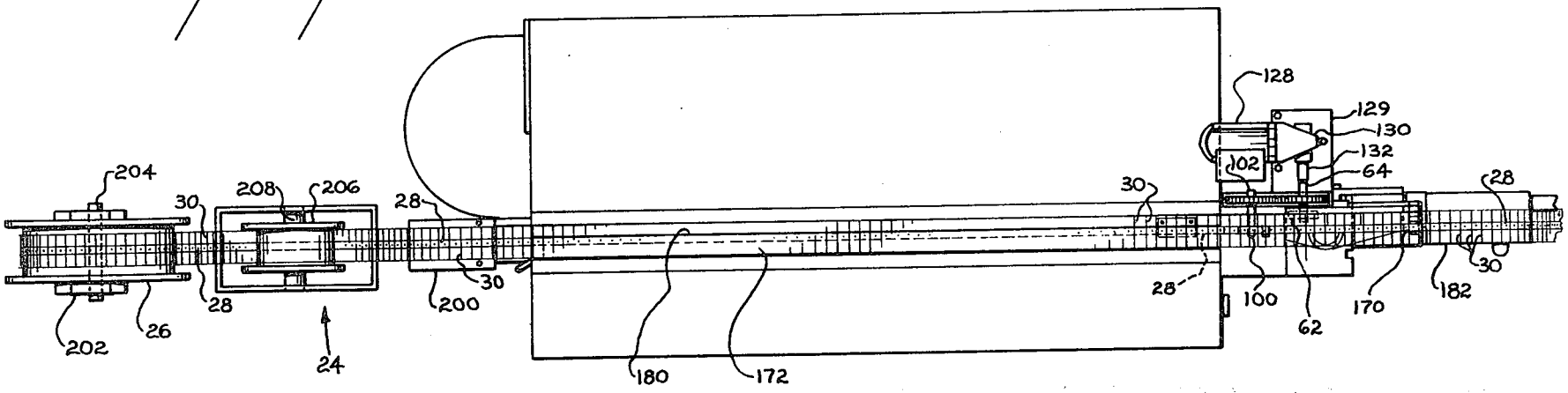
FIG. 2 is a plan view in section of the apparatus of FIG. 1 taken along line 2—2 of FIG. 1.
Figure 7:
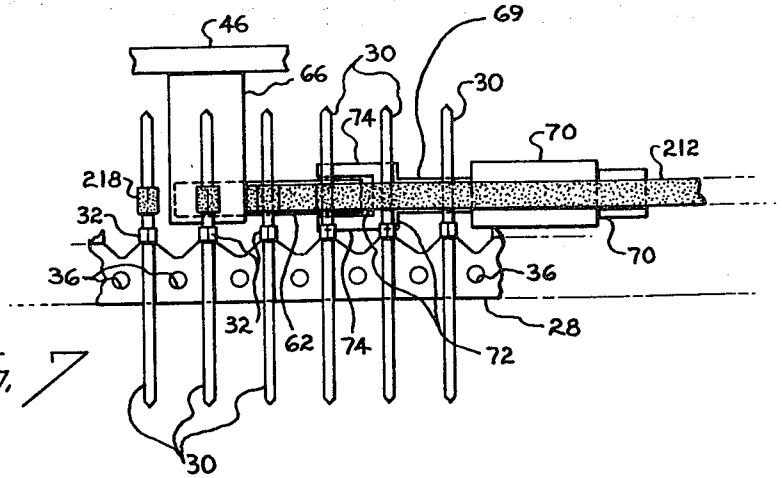
FIG. 7 is a detailed plan view of FIG. 6.

With particular reference to FIGS. 2, 3 and 4, the feed path 20 includes a first feed track section 170 extending through the coating station 16, and a second feed track 172. Each feed track comprises a base plate 174 and cover plate 176 forming trackway 178 for receiving carrier strip 28. A slot 180 between base 174 and cover plate 176 is provided for the standoffs 34 connecting ferrules 32 having the terminal pins 30 mounted therein to the carrier strip 28. Feed track 170 is mounted to plate 46 and a guide plate 182 is provided for guiding terminals on carrier strip 28 to feed track 170. Feed track 172 is mounted on a feed track cooling unit 184 on supports 186 mounted on table 14. An input port 188 to cooling unit 184 is connected to a branch cooling line 190 connected to cooling line 158. An output port 192 of cooling unit 184 is connected to the supply tank 157 by return line 194. A hood (not illustrated) can be mounted over table 14 for venting evaporated solvents from the solder paste. A guide plate 200 is mounted at the end of feed track 172.

A terminal take-up reel 26 is mounted on a shaft 204 journaled in stand 202. A conventional take-up drive (not illustrated) is provided, and the drive can include an idler arm (not illustrated) for controlling a take-up drive motor. A guide wheel 206 is rotatably journaled on shaft 208 in bath 24.

The operation of the apparatus and process of the invention can be readily understood with reference to the description which follows and the attached drawings, particularly, FIG. 6.

The carrier strip 28 is inserted into trackway 178 of feed track section 170. Sprocket 106 is disengaged from wheel 100 by lifting hand grip 126 and the carrier strip 28 is inserted in trackway 178 of feedtrack section 172. Hand grip 126 is released engaging the carrier strip 28 between sprocket 106 and wheel 100. Cogs 108 on sprocket 106 engage pilot holes 36 in the carrier strip 28 for advancing the carrier strip. The standoffs 34 extend from the carrier strip 28 through slot 180 and the terminal pins 30 mounted in ferrules 32 extend transversely of the feed path 20.

The drive motor 128 is started and the carrier strip 28 is advanced along feed path 20 through feed track sections 170 and 172. The infra-red lamp 136, cooling pump 156 and regulated air source to hopper 50 are turned on by conventional control means in control box 165.

A continuous ribbon 210 of solder paste is extruded through the needle 56 onto a medial portion 29 of each terminal pin 30. The terminal pins 30 are transported along the feed path 20 in feed track section 170 and the ribbon 210 is formed into festoons 212 of solder between adjacent terminal pins 30. The amplitude 214 of each festoon 212 is increased by gravitational force to apply the solder paste to the sides of the terminal pins 30. The festoonery comprising the terminal pins 30 and festoons 212 is transported onto a surface of the application wheel 62. The underside of each pin 30 tangentially engages the surface of the wheel and each festoon 212 between adjacent pins 30 is picked up on the surface of the wheel 62. The solder paste applied to the surface of the wheel 62 by each festoon 212 is rotated with the surface of the wheel 62. Edge 72 of leveling blade 68 spaced a predetermined distance from the surface of the wheel 62 by micrometer 70 establishes a uniform layer of solder paste of a predetermined thickness on the surface of the continuously rotating wheel 62. The uniform layer 216 of solder paste on the surface of the wheel 62 is then applied to the underside of each pin transported onto and tangentially engaging the surface of the wheel 62. The edge 67 of cut-off blade 66 severs any excess solder composition adhering to the underside of each pin 30. The excess solder is carried off by the continuously rotating wheel and falls freely from the wheel onto the inclined drip slide 82 and into the drip tank 84. The solder adhering to the surface of the wheel is levelled by the leveling blade 68, and excess solder drops into drip tank 84. The terminals 30 having a band of solder paste 218 about a medial portion attached to the carrier strip are advanced along the feed path 20 by drive sprocket 106. The carrier strip and attached terminals are transported through the heating station 18 and reflector 146 focuses infra-red radiation from lamp 136 through slot 148 on each solder band 218. The infra-red radiation evaporates a liquid vehicle of the solder paste and flows the solids of the paste to form a molten band of solder about the medial portion of the terminal pins. The cooling unit 184 cools feed track section 172 and provides a heat sink for the carrier strip 28 and ferrules 32 and pins 30 attached thereto by standoffs 34. The heat sink prevents flowing of the molten solder to the segment of the terminal pins 30 mounted in the ferrules 32. The heat sink properties of the carrier strip and feed track section 172 mounted on cooling unit 184 aid in rapidly fusing the solder on the medial portion 29 of each pin 30 exiting the heating station 18. The carrier strip 28 having the terminal pins 30 and fused solder band 38 about a medial portion thereof are guided from feed track 172 by guide plate 200 into a cleaning bath 24 which removes any flux from the terminal pins 30. The terminals are re-reeled on take-up reel 26 by conventional means.

The process of the invention is described further in the following example.

A plurality of 0.025 inch square drawn phospher bronze terminal pins with a nickel underplating and a gold overplating were coated with a band of solder using the process and apparatus of the invention. The terminal pins were mounted in ferrules attached to a carrier strip on 0.200 inch centers with each end of the terminal pins extending transversely of the carrier strip. Each pin included a star-shaped deformed mounting section of approximately 0.075 inch length along a medial portion extending transversely of the carrier strip. The hopper of the coating apparatus of the invention was loaded with a solder paste composition comprising finely-divided solder particles dispersed in a liquid vehicle. The hopper was fitted with an extrusion needle having an oval end with an approximately 0.100 × 0.040 inch orifice. The carrier strip was advanced at a speed of approximately 80 inches per minute and the solder paste composition was maintained under a pressure of 40 to 45 pounds per inch squared in the hopper. A continuous ribbon of solder paste was extruded onto the star-shaped medial portion of the pins. A 0.125 inch width application wheel was spaced approximately five inches from the extrusion needle along the feed path to provide for festooning the continuous ribbon of solder composition to cover the sides of the terminal pin. The terminal pins were transported along the feed path over the application wheel to form a band of solder paste about the medial mounting portion thereof. The terminal pins having the band of solder paste about the medial mounting portion were transported along the feed path through the infra-red heating station and the solder paste composition was flowed to provide a layer of molten solder about the medial mounting portion of each pin. The terminal pins were transported from the infra-red heating station and the molten solder layer was cooled and fused. The pins were transported through a conventional flux cleaning solvent to remove the solder flux residues on the pins. The resultant pins having a band of fused solder about the mounting portion were inserted into plated circuit board holes and the solder band was readily reflowed by application of infra-red heat to establish an electrical connection with the plated circuit board hole.

What is claimed is:

1. A process for coating a composition about an electrical element comprising, transporting a plurality of elements along a feed path with at least one segment of each element extending transversely of the feed path, extruding a continuous ribbon of a coating composition onto said segment of each element, festooning the continuous ribbon of coating composition between adjacent elements to provide a layer of coating composition on the sides of each element, and transporting the elements and festoonery onto a surface of an application wheel to apply coating compositions on the underside of each element.

2. A process, as recited in claim 1, additionally comprising the step of cutting any excess coating composition adhering to the underside of each element as the elements are transported from the surface of the application wheel.

3. A process, as recited in claim 1, additionally comprising the step of leveling the coating composition adhering to the surface of the application wheel.

4. A process for forming a solder band about a segment of an electrical element comprising, transporting a plurality of elements along a feed path with at least one segment of each element extending transversely of the feed path, extruding a continuous ribbon of a solder paste composition onto said segment of each element, festooning the continuous ribbon of solder paste between adjacent elements to provide a layer of solder paste composition on the sides of each element, and transporting the elements and festoonery onto a surface of an application wheel to apply solder paste compositions to the underside of each element, cutting any excess solder paste composition adhering to the underside of each element as the elements are transported from the surface of the application wheel, heating the segment of each element and the solder paste composition to flow the solder on each element, and cooling the molten solder to form a fused band of solder about said segment of each article.

5. A process, as recited in claim 4, additionally comprising the step of leveling the solder composition adherent to the surface of the application wheel.

6. A process, as recited in claim 4, wherein the article is a square electrical terminal pin having a deformed mounting section along a medial portion extending transversely of the carrier strip.

* * * * *